US006619376B2

(12) United States Patent
Lindgren

(10) Patent No.: US 6,619,376 B2
(45) Date of Patent: Sep. 16, 2003

(54) METHOD FOR DETECTING A SEIZED OR STILL STANDING ROLLER

(75) Inventor: Håkan Lindgren, Göteborg (SE)

(73) Assignee: Aktiebolaget SKF, Göteborg (SE)

( * ) Notice: Subject to any disclaimer, the term of this patent is extended or adjusted under 35 U.S.C. 154(b) by 0 days.

(21) Appl. No.: 10/151,860

(22) Filed: May 22, 2002

(65) Prior Publication Data

US 2002/0185254 A1 Dec. 12, 2002

(30) Foreign Application Priority Data

May 23, 2001 (SE) ..... 0101837

(51) Int. Cl.[7] ..... B22D 11/128; B22D 11/20
(52) U.S. Cl. ..... 164/454; 164/413; 164/151
(58) Field of Search ..... 164/454, 151, 164/151.2, 413

(56) References Cited

U.S. PATENT DOCUMENTS 4,056,140 A * 11/1977 Ives et al. ..... 164/454

6,470,957 B1 * 10/2002 Ashburn ..... 164/454

* cited by examiner

*Primary Examiner*—Kuang Y. Lin
(74) *Attorney, Agent, or Firm*—Burns, Doane, Swecker & Mathis, LLP

(57) ABSTRACT

A method for detecting a seized or still standing roller in a track of rollers in a continuous casting machine, in which each roller is rotatably mounted in supporting members and is arranged with its axis substantially perpendicular to the longitudinal extent of the track so that the rollers are arranged to transport elongated material produced in the machine. The method includes measuring a load exerted on at least one supporting member of each roller, with the load being substantially parallel with the extent of the track. The existence of a seized or still standing roller is established when the load deviates from a predetermined value by virtue of a force induced on the roller by seizure or stoppage of the roller at the contact with the transported material.

15 Claims, 1 Drawing Sheet

METHOD FOR DETECTING A SEIZED OR STILL STANDING ROLLER

This application is based on and claims priority under 35 U.S.C. §119 with respect to Swedish Application No. 0101837-3 filed on May 23, 2001, the entire content of which is incorporated herein by reference.

FIELD OF THE INVENTION

This invention generally relates to continuous casting machine. More particularly, the invention pertains to a method for detecting a seized or still standing roller in a continuous casting machine.

BACKGROUND OF THE INVENTION

A continuous casting machine produces steel material from molten steel. The steel material can be used for example as a starting material in rolling processes for producing sheet metal to be used in, for instance, vehicles.

In the continuous casting machine, molten steel flows from a ladle and down in a tundish from which it is transported further down into a mold. In the mold, which is water-cooled, the slab of continuous cast material begins to form a solid shell. Then, the slab is continuously transported along a curved track by a large number of rollers arranged in segments which continue to shape and cool the slab to the final thickness of the steel material. At the end of the track, the material is cut into suitable pieces.

The rollers of the continuous casting machine are rotatably mounted with their axes substantially perpendicular to the longitudinal extension or longitudinal extent of the curved track. To lead and support the slab of continuous cast material, the rollers are arranged in pairs, with each pair comprising an upper roller and a lower roller.

Further, the rollers are rotatably mounted in supporting members at each end of the rollers. Due to the length of the rollers, and thus the load on the rollers, the rollers are generally split into roller portions. The roller portions are either independently mounted in supporting members or nonrotatably provided on a common shaft, with the shaft being mounted in supporting members. The supporting members can be, for example, rolling bearings or sliding bearings. Further, the supporting member also comprises a suitable bearing housing.

During transportation of the slab along the track, each roller is supposed to rotate at a speed appropriate for providing the slab with an even conveyance without unnecessary stresses or surface wear. However, one of the rollers or several of the rollers can stop or start to seize.

Stopping or seizing of the rollers can derive from several factors. Examples include supporting member failures due to, for example, starvation of lubricant, particles blocking the supporting member or deformation of the rolling elements in a rolling bearing. A further factor is slag and dirt from the cooling water that has been deposited on the frame of the machine or on the rollers. This slag can disturb the function of the machine.

When one roller or several rollers stop or begin to seize, the material will be negatively effected. For example, scratches are very likely to appear on the slab surface. These scratches can of course be treated by, for instance, grinding or remelting the surface layer. However, any treatment of the material after the casting process necessarily beings about an increase in costs.

In the beginning of the process where the solidified layer is thin, a more serious problem can occur. This is referred to as a "break out". During a break out, the slab is badly damaged as the solidified surface layer is torn open so that the inner molten material is able to flow out.

It would thus be desirable to detect the stoppage or seizure of rollers that cause scratches and/or break outs to the material being cast to avoid the need for costly treatment of the material after the casting process.

SUMMARY OF THE INVENTION

According to one aspect, a method is provided for detecting a seized or still standing roller in a track of rollers in a continuous casting machine, with each roller being rotatably mounted in supporting members and arranged with its axis substantially perpendicular to a longitudinal extent of the track, and with the rollers being arranged for transporting elongated material produced in the continuous casting machine. The method includes measuring a load, which is substantially parallel with a direction of extent of the track, exerted on at least one supporting member of each roller, and establishing the existence of a seized or still standing roller when the measured load deviates from a predetermined value by virtue of a force induced on the roller by seizure or stoppage of the roller at contact with the elongated material.

According to another aspect, a method for detecting a seized or still standing roller in a continuous casting machine comprises transporting elongated material produced in the continuous casting machine along a track of rollers each rotatably mounted in supporting members and having an axis arranged substantially perpendicular to a longitudinal extent of the track, measuring a load in a direction along the direction of extent of the track that is exerted on at least one supporting member of a plurality of the rollers, comparing the measured load exerted on the at least one supporting member of each of the plurality of rollers to a predetermined value, and determining that at least one of the plurality of rollers is seized or is a still standing roller when the measured load in the at least one supporting member of the at least one of the plurality of rollers deviates from the predetermined value.

BRIEF DESCRIPTION OF THE DRAWING FIGURES

The foregoing and additional features and characteristics of the present invention will become more apparent from the following detailed description considered with reference to the accompanying drawing figures in which like reference numerals designate like elements.

DETAILED DESCRIPTION OF THE INVENTION

Figure 1:
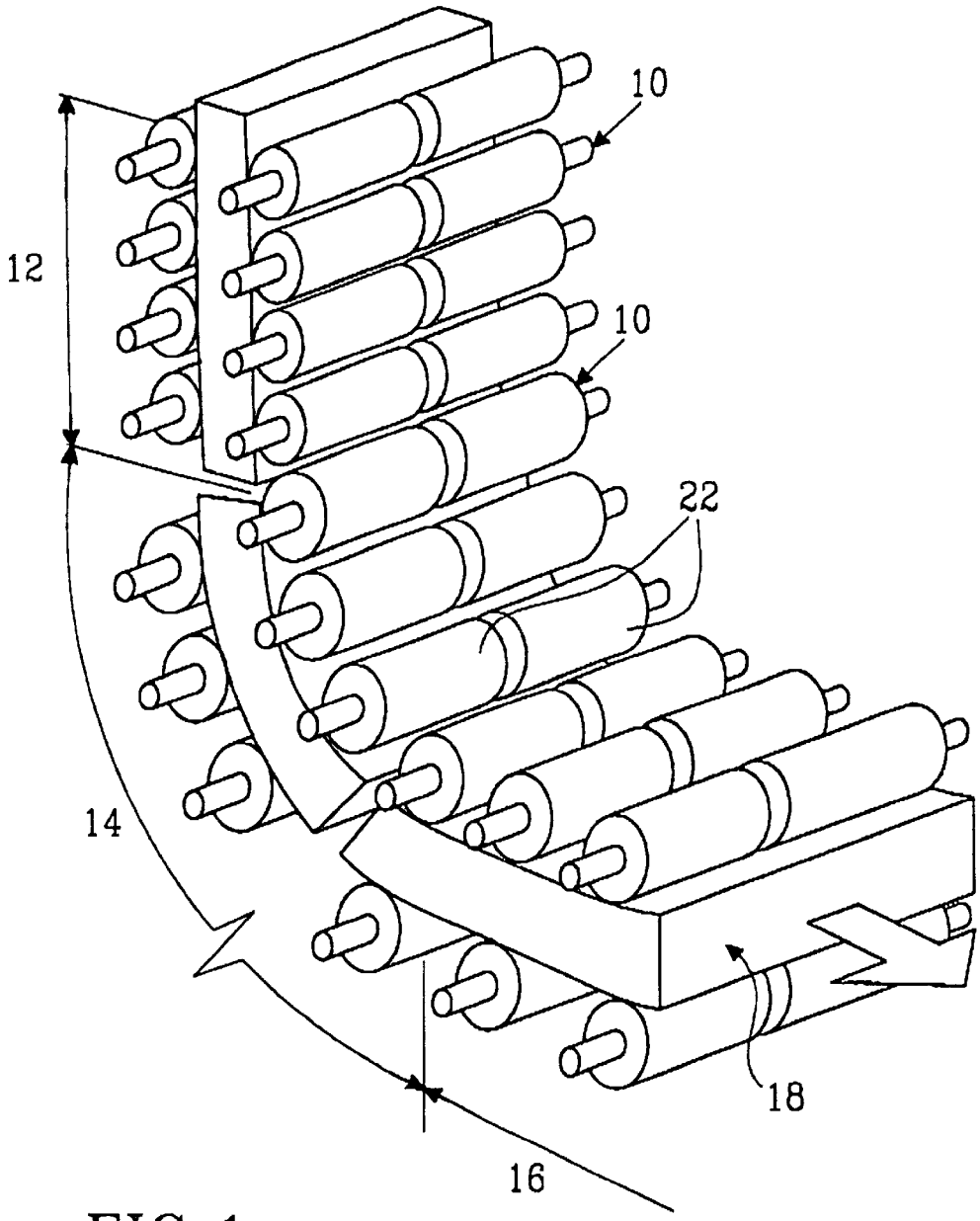
FIG. 1 is a schematic perspective view a set of rollers of a continuous casting machine.

FIG. 1 schematically illustrates a row of rollers 10 of a section of a continuous casting machine including a top segment 12, an inside cooling chamber 14 and an outside cooling chamber 16. The rollers 10 form a track and are arranged in pairs to lead and support the slab 18 of a continuous length of continuous cast material. In the top segment 12, the slab 18 has a more or less liquid core. During feeding under continuous movement in the direction shown by the arrow, the slab 18 solidifies as it is cooled off.

Each of the rollers 10 is mounted with its axis substantially perpendicular to the longitudinal extension line or longitudinal extent of the track. The rollers are each rotatably mounted in supporting members 20 at each end of each roller 10.

Generally, the rollers 10 are split into roller portions 22 positioned axially adjacent or axially after each other. The roller portions 22 are either independently mounted in supporting members 20 or non-rotatably provided on a common shaft, with the shaft being mounted in supporting members. Preferably, the supporting member can comprise a rolling bearing with a corresponding bearing housing. Alternatively, the supporting member can be a sliding bearing with a bearing housing.

Figure 2:
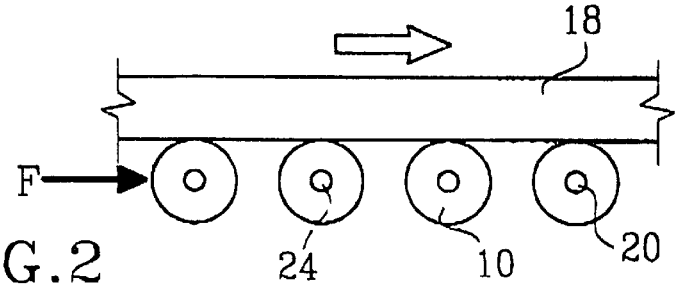
FIG. 2 is a schematic side view of the force being measured on a roller in accordance with the invention.

Referring to FIG. 2, an embodiment of the present invention will now be described. In the described example, only one row of rollers 10 in a continuous casting machine will be considered and described. In addition, to simplify the explanation of this example, the rollers 10 are not illustrated and described as being split into roller portions, although the invention is applicable to rollers split into roller portions.

In the continuous casting machine, the slab 18 of continuous cast material is transported along the row of rollers 10 in the direction indicated by the arrow. During transportation of the slab 18 along the track, each roller 10 is rotating at a speed which is appropriate for giving the slab 18 an even conveyance and an even cooling. When this process is correctly operating, there will be no forces or insignificant forces close to zero arising substantially parallel with the extension line or direction of extent of the track. The small forces that may exist are caused by, for instance, friction in the seals of the supporting members 20.

If, however, one of the rollers or several rollers 10 stop or begin to seize, significant friction forces will arise in the contact surface between the transported elongated material 18 and the seized or still standing roller or rollers 10. Such a friction force exerts a load, denoted F, on the supporting members 20 of the roller 10. This load F is substantially parallel with the extension line or direction of extent of the track.

The method here involves detecting a seized or still standing roller 10 by measuring the load F exerted on at least one supporting member 20 of the roller 10. This load F, as mentioned above, is substantially parallel with the extension line or direction of extent of the track. The existence of a seized or still standing roller 10 can then be established by detecting or determining that the measured load F deviates from a predetermined value, with such value being substantially small.

According to the method, a suitable measuring device 24 is provided in at least one supporting member 20 of each roller 10. This measuring device 24 is able to measure the load F acting in the supporting member 20 throughout the casting operation and provide information useful for determining the presence of a seizure or stoppage of the roller 10 at the contact with the transported elongated cast material 18.

To carry out the method, a comparison or predetermined value is determined to indicate a situation in which a stoppage or seizure most likely has occurred. That is, a value showing the highest friction force F substantially parallel with the direction of extent of the track that is allowed without having to assume a stoppage or seizure of the roller 10.

Preferably, the actual load F exerted on each roller 10 is then measured. Advantageously, the measuring is performed at at least one supporting member 20 of each roller 10 through operation of the measuring device 24. The value obtained is then compared with the predetermined "allowable" value. When the actual value is lower (less) than or equal to the predetermined value, it is established or determined that there is no stoppage or seizure of the roller 10. However, if the actual value is higher (greater) than the predetermined value, it is established or determined that there exists a stoppage or seizure of the roller 10. The predetermined value to which the actual load is compared can be zero or a value other than zero (e.g., a value close to zero).

Thus, the still standing or seized roller or rollers 10 can be found, examined and repaired. For instance, the supporting members 20 can be exchanged or slag can be removed from the roller 10 or machine frame.

The principles, preferred embodiments and modes of operation of the present invention have been described in the foregoing specification. However, the invention which is intended to be protected is not to be construed as limited to the particular embodiments disclosed. Further, the embodiments described herein are to be regarded as illustrative rather than restrictive. Variations and changes may be made by others, and equivalents employed, without departing from the spirit of the present invention. Accordingly, it is expressly intended that all such variations, changes and equivalents which fall within the spirit and scope of the present invention as defined in the claims, be embraced thereby.

What is claimed is:

1. Method for detecting a seized or still standing roller in a continuous casting machine, comprising:

transporting elongated material produced in the continuous casting machine along a track of rollers each rotatably mounted in supporting members and having an axis arranged substantially perpendicular to a longitudinal extent of the track;

measuring a load along a direction of extent of the track that is exerted on at least one supporting member of a plurality of the rollers;

comparing the measured load exerted on the at least one supporting member of each of the plurality of rollers to a predetermined value; and determining that at least one of the plurality of rollers is seized or is a still standing roller when the measured load in the at least one supporting member of the at least one of the plurality of rollers deviates from the predetermined value.

2. Method according to claim 1, wherein the predetermined value is zero.

3. Method according to claim 1, wherein the predetermined value is other than zero.

4. Method according to claim 1, wherein the supporting member is a rolling bearing.

5. Method according to claim 1, wherein the supporting member is a sliding bearing.

6. Method according to claim 1, wherein the supporting member comprises a measuring device.

7. Method according to claim 1, including measuring the load substantially parallel with the direction of extent of the track that is exerted on at least one supporting member of each of said rollers, and comparing the measured load exerted on the at least one supporting member of each of the rollers to the predetermined value.

8. Method according to claim 1, wherein the track of rollers includes two spaced apart rows of rollers between which the elongated material is transported.

9. Method according to claim 1, wherein each of the rollers is split into roller portions.

10. Method for detecting a seized or still standing roller in a track of rollers in a continuous casting machine, with each roller being rotatably mounted in supporting members and arranged with its axis substantially perpendicular to a longitudinal extent of the track, the rollers being arranged for transporting elongated material produced in the continuous casting machine, the method comprising:

measuring a load, which is substantially parallel with a direction of extent of the track, exerted on at least one supporting member of each roller; and establishing existence of a seized or still standing roller when the measured load deviates from a predetermined value by virtue of a force induced on the roller by seizure or stoppage of the roller at contact with the elongated material.

11. Method according to claim 10, wherein the predetermined value is zero.

12. Method according to claim 10, wherein the predetermined value is other than zero.

13. Method according to claim 10, wherein the supporting member is a rolling bearing.

14. Method according to claim 10, wherein the supporting member is a sliding bearing.

15. Method according to claim 10, wherein the supporting member comprises a measuring device.

* * * * *